US008932068B2

(12) United States Patent
Yin et al.

(10) Patent No.: US 8,932,068 B2
(45) Date of Patent: Jan. 13, 2015

(54) COMPUTER WITH SERIAL ADVANCED TECHNOLOGY ATTACHMENT CONNECTOR

(75) Inventors: Xiao-Gang Yin, Shenzhen (CN); Meng-Liang Yang, Shenzhen (CN)

(73) Assignee: ScienBiziP Consulting (Shenzhen) Co., Ltd., Guangdong (CN)

( * ) Notice: Subject to any disclaimer, the term of this patent is extended or adjusted under 35 U.S.C. 154(b) by 393 days.

(21) Appl. No.: 13/421,866

(22) Filed: Mar. 16, 2012

(65) Prior Publication Data

US 2013/0050929 A1 Feb. 28, 2013

(51) Int. Cl.
*H01R 25/00* (2006.01)
*H01R 29/00* (2006.01)

(52) U.S. Cl.
CPC ..... *H01R 29/00* (2013.01)
USPC ..... 439/79; 439/510; 435/287.1; 422/550; 422/500; 709/250

(58) Field of Classification Search
USPC ..... 439/79, 510, 507, 512; 435/287.1, 435/287.2, 287.3; 422/519, 72, 550, 524, 422/509, 500; 709/250, 203
See application file for complete search history.

(56) References Cited

U.S. PATENT DOCUMENTS

| | | | | |
|---|---|---|---|---|
| 4,686,506 | A * | 8/1987 | Farago | 341/100 |
| 5,148,354 | A * | 9/1992 | Roth | 361/760 |
| 5,870,621 | A * | 2/1999 | Walsh et al. | 712/32 |
| 6,614,652 | B2 * | 9/2003 | White et al. | 361/679.32 |
| 7,481,679 | B1 * | 1/2009 | Stotz et al. | 439/638 |
| 2002/0173188 | A1 * | 11/2002 | Follingstad et al. | 439/188 |

* cited by examiner

*Primary Examiner* — Gary Paumen
(74) *Attorney, Agent, or Firm* — Novak Druce Connolly Bove + Quigg LLP

(57) ABSTRACT

A computer includes a number of hard disk drives (HDDs), a number of Serial Advanced Technology Attachment (SATA) connectors correspondingly connected to the HDDs, and a number of jumpers. Each SATA connector includes a power supply pin, a spin-up pin, a ground pin, and a pin base with first to third pins. The first to the third pins are respectively connected to the power supply pin, the spin-up pin, and the ground pin. The second pin of each SATA connector is connected to either the first pin or the third pin by a corresponding jumper, thereby the corresponding HDD starts up with the computer or starts up at a preset time after the computer has started up.

6 Claims, 3 Drawing Sheets

COMPUTER WITH SERIAL ADVANCED TECHNOLOGY ATTACHMENT CONNECTOR

BACKGROUND

1. Technical Field

The present disclosure relates to a computer having a Serial Advanced Technology Attachment (SATA) connector.

2. Description of Related Art

When a spin-up pin of a SATA connector of a computer, which is generally the eleventh pin of the SATA connector, is idle, a hard disk drive (HDD) connected to the SATA connector may start up with the computer. Power consumed by the HDD starting up is three times greater than the power consumed by the HDD during normal operations after start up, therefore, when a plurality of HDDs start up simultaneously, the amount of power drawn by the HDDs may make a power supply of the computer become unstable. The firmware of the computer is generally setup to control the computer to output a low voltage level, such as logic 0, to the spin-up pin of the corresponding SATA connector by a computer expert, to sequence the HDDs. However, it's difficult for a layperson to setup the firmware of the computer to sequence the HDDs. Therefore, there is room for improvement in the art.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
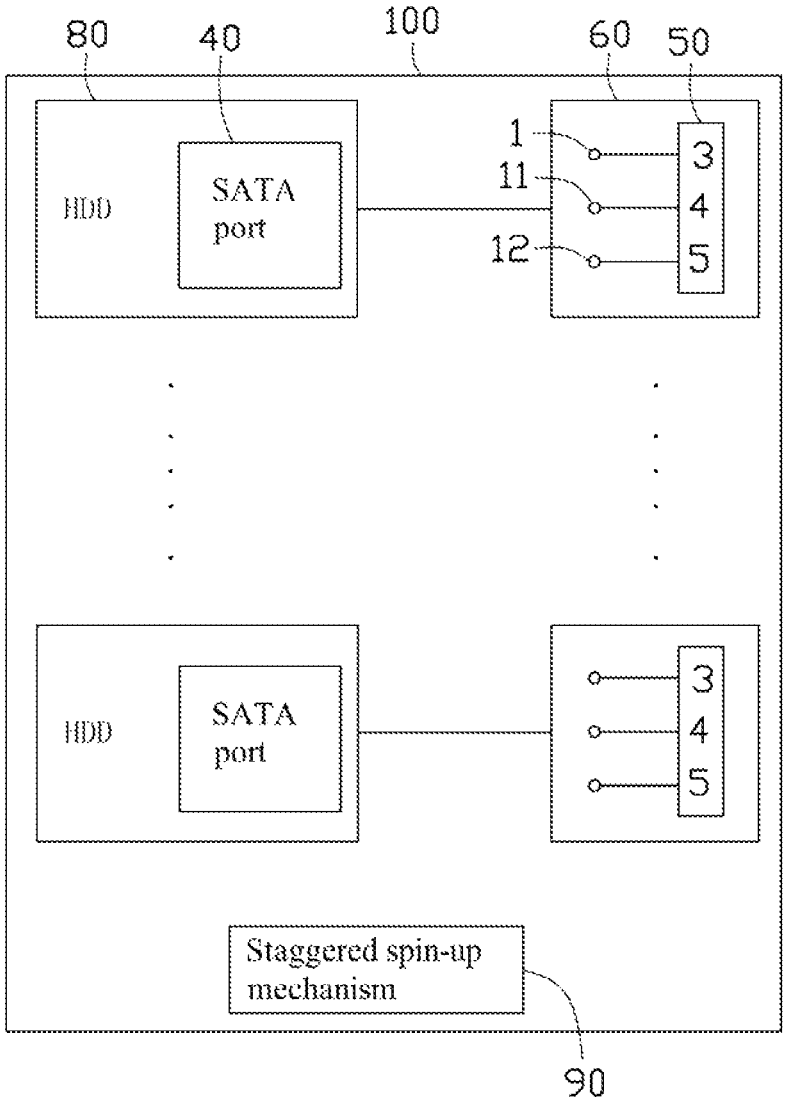
FIG. 1 is a block diagram of an exemplary embodiment of a computer, wherein the computer includes a serial advanced technology attachment (SATA) connector and a hard disk drive (HDD).

Referring to FIG. 1, an exemplary embodiment of a computer 100 includes a plurality of hard disk drives (HDDs) 80, and a plurality of Serial Advanced Technology Attachment (SATA) connectors 60 correspondingly connected to the HDDs 80.

Each HDD 80 includes a SATA port 40 connected to a corresponding one of the SATA connectors 60. Each SATA connector 60 includes a power supply pin 1, a spin-up pin 11, and a ground pin 12 grounded. According to the SATA standard specification, when the spin-up pin 11 is idle, the signal at the spin-up pin 11 has a high voltage level, such as logic 1. At this time, the corresponding HDD 80 is not controlled by a staggered spin-up mechanism 90 of the computer 100, and will start up with the computer 100. When the signal at the spin-up pin 11 has a low voltage level, such as logic 0, the corresponding HDD 80 will spin up at a preset time after the computer 100 starts up, under the control of the staggered spin-up mechanism 90.

Figure 2:
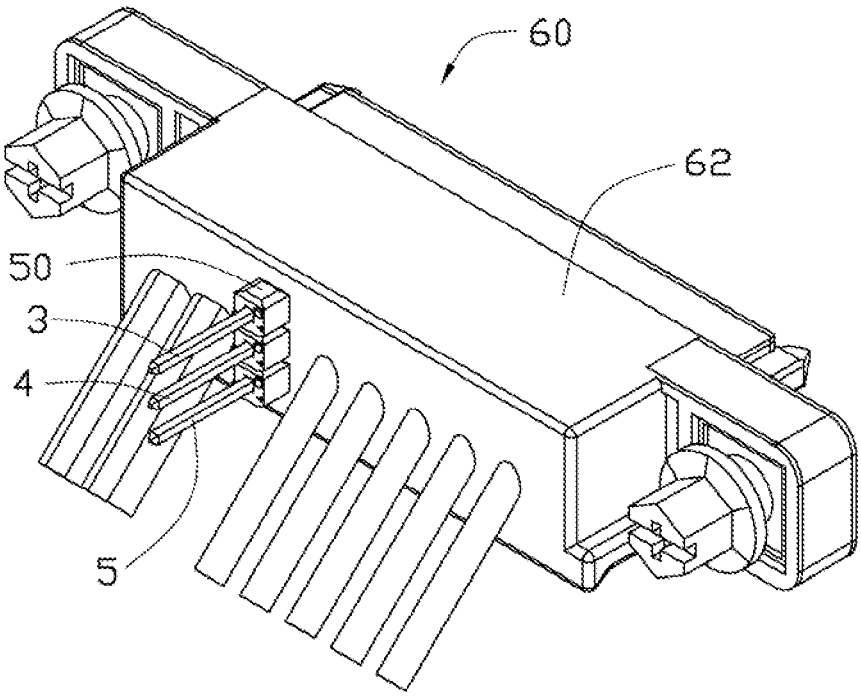
FIG. 2 is an isometric view of the SATA connector of FIG. 1.

Referring to FIG. 2, each SATA connector 60 includes a housing 62, and a pin base 50 mounted on the rear surface of the housing 62. Pins 3-5 are mounted on the rear surface of the pin base 50 opposite to the housing 62. The pins 3-5 are respectively connected to the power supply pin 1, the spin-up pin 11, and the ground pin 12. In other embodiments, the pin base 50 may be mounted on other side surfaces of the housing 62, and the pins 3-5 may be mounted on other side surfaces of the pin base 50.

Figure 3:
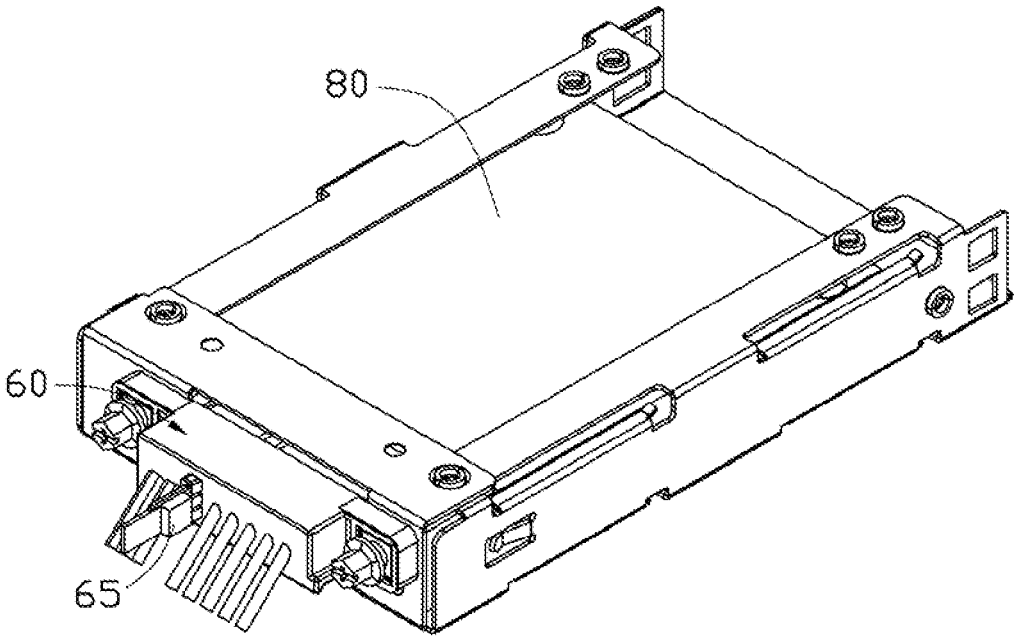
FIG. 3 is an assembled, isometric view of the SATA connector and the HDD of FIG. 1.

Referring to FIG. 3, in use, when any one of the HDDs 80 does not need to start up with the computer 100, the pins 4 and 5 of the corresponding SATA connector 60 are connected to each other by a jumper 65, thus the corresponding spin-up pin 11 is connected to the ground pin 12. The signal at the spin-up pin 11 has a low voltage level. Therefore, the HDD 80 will start up at a preset time after the computer 100 has started up. When any one of the HDDs 80 is needed to start up with the computer 100, the pins 3 and 4 of the corresponding SATA connector 60 are instead connected to each other by the jumper 65, thus the corresponding spin-up pin 11 is connected to the power supply pin 1. The signal at the spin-up pin 11 has a high voltage level. Therefore, the HDD 80 will start up with the computer 100.

The foregoing description of the exemplary embodiments of the disclosure has been presented only for the purposes of illustration and description and is not intended to be exhaustive or to limit the disclosure to the precise forms disclosed. Many modifications and variations are possible. The embodiments were chosen and described in order to explain the principles of the disclosure and their practical application so as to enable others of ordinary skill in the art to utilize the disclosure and various embodiments and with such various modifications as are suited to the particular use contemplated. Alternative embodiments will become apparent to those of ordinary skills in the art to which the present disclosure pertains without departing from its spirit and scope. Accordingly, the scope of the present disclosure is defined by the appended claims rather than by the foregoing description and the exemplary embodiments described therein.

What is claimed is:

1. A Serial Advanced Technology Attachment (SATA) connector for connecting a hard disk drive (HDD), comprising:

a housing;

a pin base mounted on the housing, and comprising first to third pins;

a power supply pin connected to the first pin of the pin base;

a ground pin connected to the third pin of the pin base;

a spin-up pin connected to the second pin of the pin base, wherein when the signal at the spin-up pin has a low voltage level, the HDD is controlled to start up at a preset time under the control of a staggered spin-up mechanism of the computer, when the spin-up pin has a high voltage level, the HDD starts up with the computer; and a jumper for connecting the second pin of the pin base to either the first pin of the pin base or the third pin of the pin base.

2. The SATA connector of claim 1, wherein the pin base is mounted on a rear surface of the housing.

3. The SATA connector of claim 1, wherein the first to the third pins of the pin base are mounted on a rear surface of the pin base.

4. A computer, comprising:

a plurality of Serial Advanced Technology Attachment (SATA) connectors, each SATA connector comprising:

a housing;

a pin base mounted on the housing, and comprising a first to a third pins;

a power supply pin connected to the first pin of the pin base;

a ground pin connected to the third pin of the pin base;

a spin-up pin connected to the second pin of the pin base; and a jumper for connecting the second pin of the pin base to either the first pin of the pin base or the third pin of the pin base;

a plurality of first hard disk drives (HDDs) connected to the SATA connectors whose second pins are connected to the third pins through the corresponding jumpers, thereby causing the corresponding spin-up pins having a low voltage level, the first HDDs start up at a present sequence under the control of staggered spin-up mechanism of the computer, after the computer has started up; and a plurality of second HDDs connected to the SATA connectors whose second pins are connected to the first pins through the corresponding jumpers, thereby causing the corresponding spin-up pins having a high voltage level, the second HDDs start up with the computer.

5. The computer of claim 4, wherein the pin base is mounted on a rear surface of the housing.

6. The computer of claim 4, wherein the first to the third pins are mounted on a rear surface of the pin base.

* * * * *